US006409619B1

(12) United States Patent
Sjöblom

(10) Patent No.: US 6,409,619 B1
(45) Date of Patent: Jun. 25, 2002

(54) ARRANGEMENT IN CONNECTION WITH BELT DRIVE DEVICE

(75) Inventor: Jarkko Sjöblom, Nummela (FI)

(73) Assignee: Maillefer S.A., Ecublens (CH)

( * ) Notice: Subject to any disclaimer, the term of this patent is extended or adjusted under 35 U.S.C. 154(b) by 0 days.

(21) Appl. No.: 09/623,236

(22) PCT Filed: Mar. 24, 1999

(86) PCT No.: PCT/FI99/00241

§ 371 (c)(1),
(2), (4) Date: Sep. 25, 2000

(87) PCT Pub. No.: WO99/48785

PCT Pub. Date: Sep. 30, 1999

(30) Foreign Application Priority Data

Mar. 26, 1998 (FI) ..... 980683

(51) Int. Cl.[7] ..... F16H 7/22; F16H 7/14

(52) U.S. Cl. ..... 474/107; 474/101; 474/112; 474/116; 474/102

(58) Field of Search ..... 474/130, 117, 474/107, 101, 102, 123, 133–138, 113–116; 340/675, 668; 384/447, 255; 83/155

(56) References Cited

U.S. PATENT DOCUMENTS 3,416,384 A * 12/1968 Maca ..... 474/112
3,467,450 A * 9/1969 Schmidt et al. ..... 384/447
3,708,135 A * 1/1973 Lace ..... 242/326.1
3,832,910 A 9/1974 Bryant
3,852,387 A * 12/1974 Bortnick et al. ..... 264/165
3,949,805 A 4/1976 Hazelett et al.
4,015,921 A * 4/1977 De Mets ..... 425/371
4,173,278 A 11/1979 Reitter
4,532,500 A * 7/1985 Henk ..... 340/675
5,302,162 A 4/1994 Pasero
5,368,212 A 11/1994 Koch
5,399,125 A * 3/1995 Dozier ..... 474/117
5,533,658 A 7/1996 Benedict et al.
5,640,891 A * 6/1997 Hoffa ..... 83/155
5,676,613 A * 10/1997 Valcourt et al. ..... 474/102
5,692,859 A 12/1997 Dickson et al.

FOREIGN PATENT DOCUMENTS

EP 0 185 788 A1 7/1986
EP 0 277 358 A2 8/1988
EP 0 469 818 A2 2/1992

* cited by examiner

*Primary Examiner*—David A. Bucci
*Assistant Examiner*—Marcus Charles
(74) *Attorney, Agent, or Firm*—Oliff & Berridge PLC

(57) ABSTRACT

An arrangement in connection with a belt drive device having two counter-rotating continuous belts operated by drive rollers traveling around stretching rollers, whereby the belts are urged towards one another by press rolls to draw a cable between the belts. Adjustment of the stretching rollers is provided by an adjustment mechanism that effects the axle with which the stretching rollers are associated.

14 Claims, 2 Drawing Sheets

ARRANGEMENT IN CONNECTION WITH BELT DRIVE DEVICE

BACKGROUND OF THE INVENTION

The invention relates to an arrangement in connection with a belt drive device which comprises two continuous drive belts arranged to be operated by means of drive rollers which to travel around stretching rollers as continuous and adjacent loops at a distance from each other and which are arranged to be pressed by means of press rolls against the opposite surfaces of a cable or the like to be drawn. Adjustment of the stretching roller of the belt drive device is provided by an adjustment means which effect a dead axle of the stretching roller.

DESCRIPTION OF THE RELATED ART

At present, belt drive devices mentioned above are commonly used in cable production lines, for instance. Flat transmission belts, i.e. belts whose both surfaces are smooth, are commonly used as cable driving belts, for example. Drive belts in which the surface that is being pressed against the cable is shaped in a suitable manner are also used in the field.

The tightness of drive belts must be adjustable as required by the process. In other words, the belts must have a correct tightness during each process, The tightness of the belts is adjusted automatically by hydraulic or pneumatic cylinders, for example. The belt must also be prevented from slipping off the wheel. This can be performed by adjusting the axial angle of the stretching roller with respect to the direction of movement of the belt. The adjustment of the axial angle of the stretching roller has previously been performed by stopping the belt drive device for the adjustment, since the adjustment must be performed in a danger area. The adjustment of the prior art has been performed by winding eccentric sleeves arranged between a bearing arranged inside the stretching roller and the axle. It is to be noted that, for reason of safety, the arrangement cannot be used when the shelters are opened.

A drawback of the prior art is that the effect of adjustment is not immediately visible and, commonly, readjustment is necessary. In that case, the drive belt must be stopped to enable additional adjustment to be performed. These procedures must sometimes be carried out several times consecutively. A further problem occurs and if the adjustment is performed without a cable, whereby the rotational force caused by the torsional movement of the cable starts moving the belts when the device is then run with a cable. The belts move in such a manner that the top belt moves in one direction and the lower belt in the other direction. This also results in stopping the drive device, readjusting, restarting, etc.

SUMMARY OF THE INVENTION

An object of the invention is to provide an arrangement by which the drawbacks of the prior art can be eliminated. This is achieved by the arrangement of the invention, which is characterized in arranging the adjustment means on the side of the opposite end of the axle with respect to the stretching roller.

Above all, an advantage of the invention occurs whereby adjustment can be performed considerably faster than in the prior art. This is due to the adjustment of the axial angle of a stretching roller being performed while the drive belt device is running and the stretching roller is rotating. The adjustment of the axial angle of the stretching roller can thus be performed while the device is running. Performing the adjustment is perfectly safe since the shelters need not be opened and no procedure needs to be performed in the danger area. A further advantage of the invention is that it is simple and inexpensive to implement. Compared with the prior art, implementation causes no considerable extra costs.

BRIEF DESCRIPTION OF THE DRAWINGS

The invention will be described in closer detail in the following by means of an example of a preferred embodiment shown in the accompanying drawings, in which.

DETAILED DESCRIPTION OF PREFERRED EMBODIMENT(S)

Figure 1:
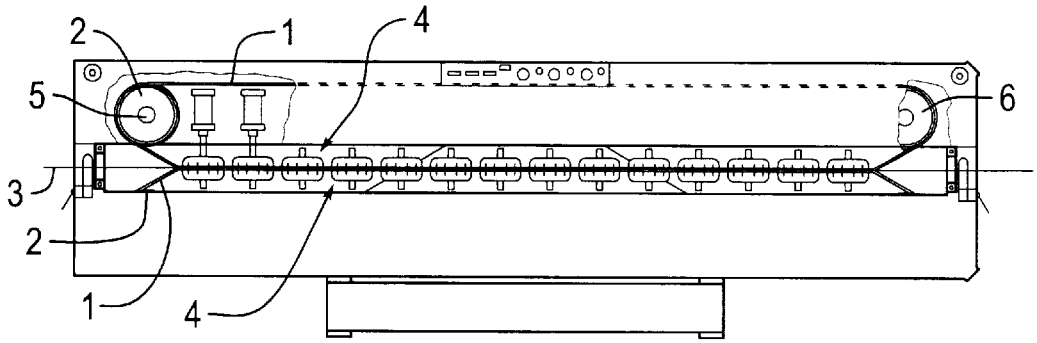
FIG. 1 is a schematic side view of a belt drive device.

FIG. 1 schematically shows a belt drive device. The belt drive device comprises two continuous drive belts 1 which are driven by means of drive rollers 2. The drive rollers 2 are driven by means of a suitable power source, for example an electric motor. The drive belts 1 are arranged to travel at a distance from each other as continuous loops around stretching rollers 6, whereby a cable 3, or the like, is arranged to travel between the drive belts in such a manner that the drive belts are pressed against the cable 3, or the like, drawing it along as they travel. The drive belts 1 are made to be pressed against the cable 3, or the like, by means of press rolls 4 which are pressed against the inner surfaces of the drive belts 1 at the point of the cable 3, or the like. In the situation of FIG. 1, the direction of movement of the cable 3, or the like, is from the right to the left. The direction of movement is marked in FIG. 1 by means of an arrow.

The above matters are known to those skilled in the art, so they will not be discussed here in further detail.

Figure 2:
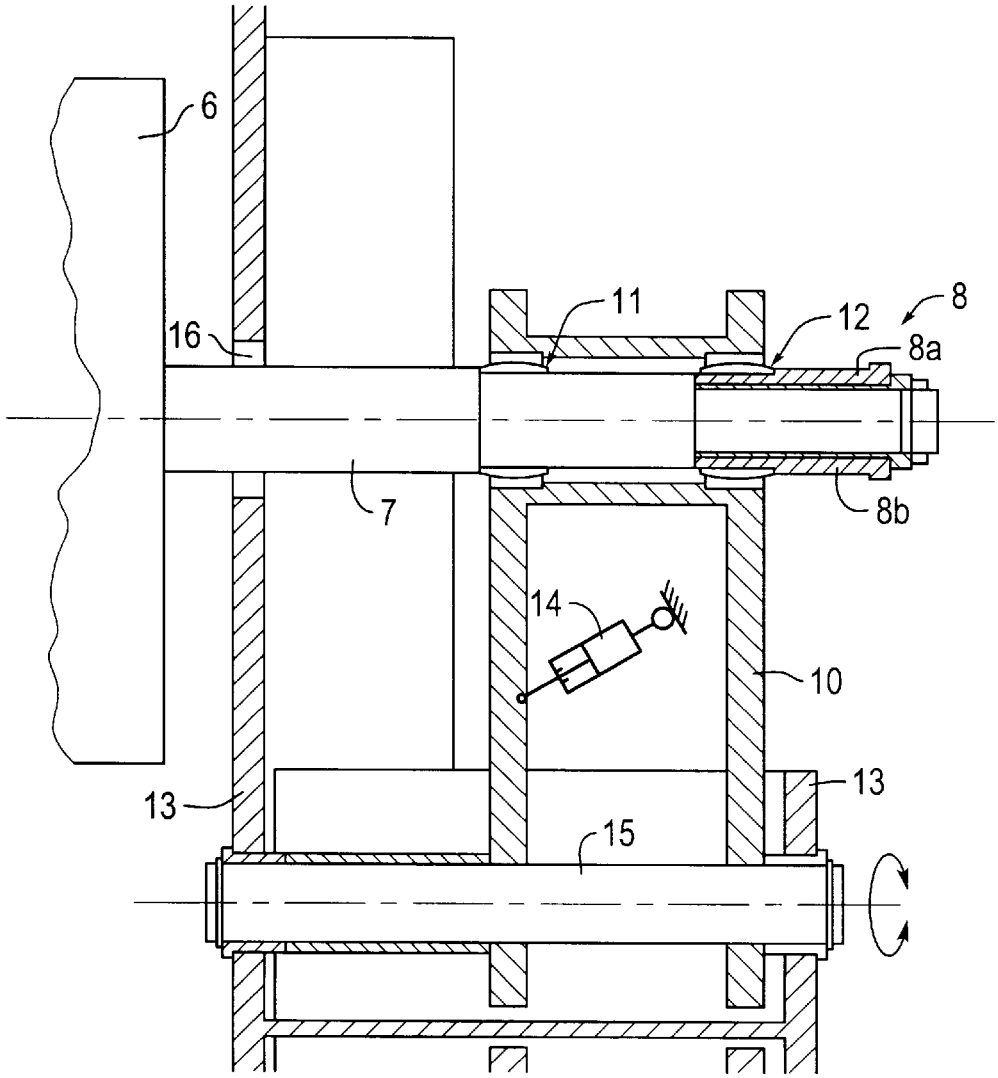
FIG. 2 is a view of an arrangement of the invention seen in a perpendicular direction with respect to the rotation axle of a stretching roller.

FIG. 2 schematically shows an arrangement of the invention. The adjustment of an axial angle of a stretching roller 6 is arranged to be performed by adjustment means 8 which effect the end of an axle 7 which is opposite to the end on which the stretching roller 6 is fastened. In the example of FIG. 2, the adjustment means 8 comprise eccentric sleeves 8*a,* 8*b*. The adjustment of the stretching roller is performed by rotating the sleeves, whereby the position of the axle 7, and simultaneously the position of the stretching roller 6, are changed. According to the basic idea of the invention, the eccentric sleeves 8*a,* 8*b* are arranged on the side of the opposite end of the axle 7 with respect to the stretching roller 6. This can be clearly seen in FIG. 2. In FIG. 2, reference number 10 refers to a part which belongs to a belt stretching leverage and which is supported to a frame 13 of the drive device. The part 10, which belongs to the belt stretching leverage, is arranged to rotate around an axle 15 schematically shown in FIG. 2 by means of a cylinder device 14, whereby the belt becomes stretched or loosened, depending on the rotation direction of the part 10. The arrow in the figure illustrates how the part 10 rotates round the axle 15. In FIG. 2, reference number 16 refers to an opening, which serves as a play, which enables the axle 7 to move when the belts are being stretched. Reference number 6 in FIG. 2 refers to a schematic stretching roller. The axle 7 and the stretching roller 6 are attached to each other by means of a suitable bearing device (not shown in FIG. 2). The cylinder device 14 can be a hydraulic or pneumatic cylinder, for instance, as described above. Further, it is to be noted that instead of the cylinder device 14, any other suitable device, for instance mechanical solutions, etc., can naturally be used.

As can been seen from the example in FIG. 2, the position of the axial angle of the stretching roller can be adjusted with respect to the direction of movement of the belt by winding the eccentric sleeves 8*a,* 8*b* around the center axis of the axle 7. Hence, the axle 7 rotates according to how the thickest and thinnest points of the eccentric sleeves 8*a,* 8*b* are located with respect to each other. Adjusting the axial angle aims to keep the belt in the correct position while the device is running. In addition, surfaces 11, 12, which serve as joint points, are arranged in the structure. In the example of FIG. 2, the surfaces 11, 12 operating as joint points are formed of compatible arched surfaces arranged in connection with the part 10. The part 10 operates as the supporting part of the axle 15 and the axle 7, and the part 10 and the outer eccentric sleeve 8*a,* respectively. When the eccentric sleeves 8*a,* 8*b* rotate, the axle 7 rotates on the joint points formed by the surfaces 11, 12. As a result, the position of the stretching roller 6 pivoted at the end of the axle 7 is changed.

Since the adjustment means of the stretching roller 6 are arranged at the end of the axle 7 away from the stretching roller in the arrangement of the invention, a considerable advantage is gained, whereby the position of the axial angle of the stretching roller can be adjusted "from behind" with no need to enter the dangerous operating area where, for instance, the rotating stretching roller and moving drive belt are located. Above all, an advantage of the structure shown in FIG. 2 is that the stretching roller can be adjusted safely from behind the belt drive device, in which case the danger area needs not be entered at all when the device is being adjusted. The position of the axial angle of the stretching roller can thus be adjusted while the device is running, if necessary, which makes repeated readjusting unnecessary.

Figure 3:
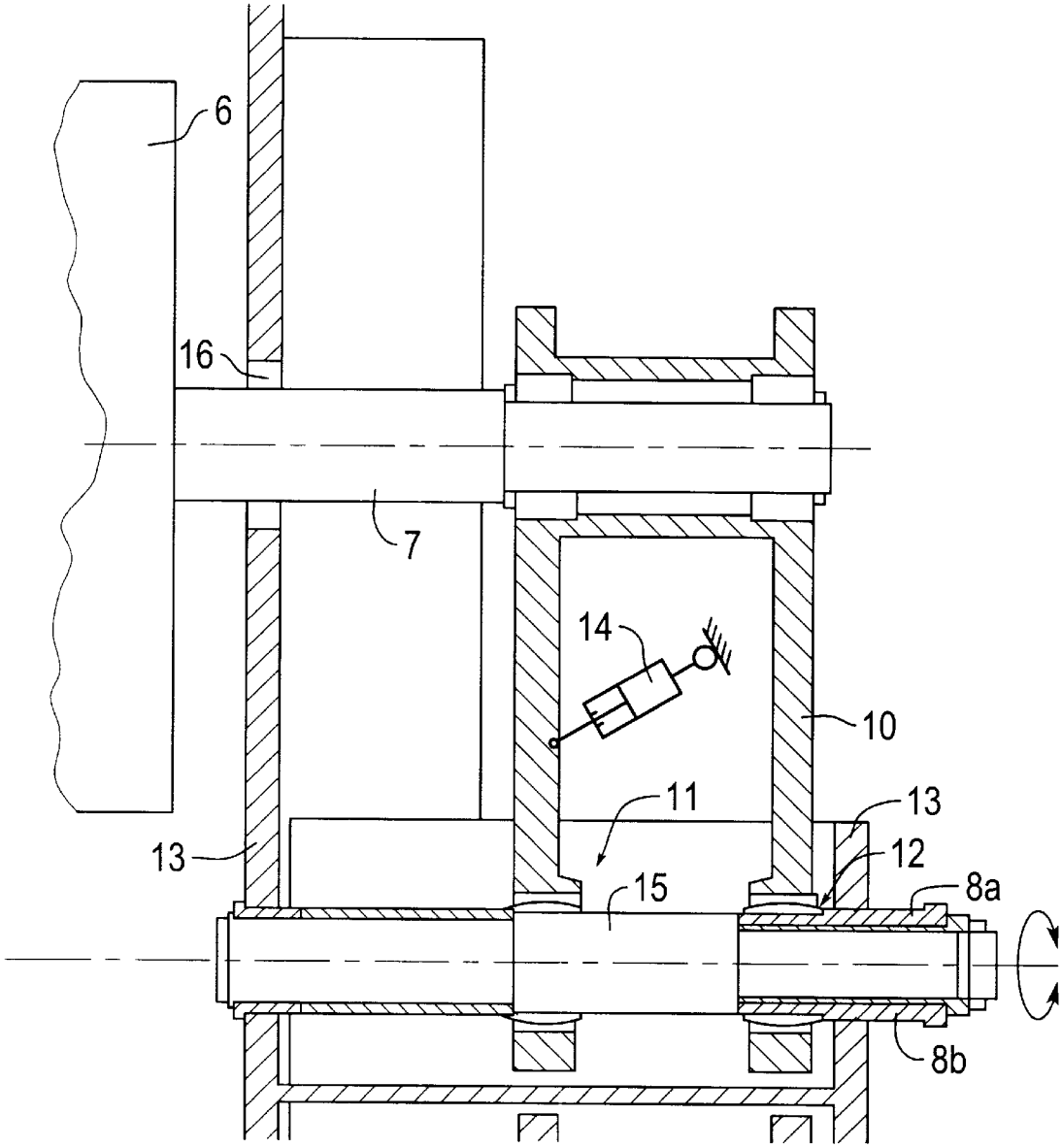
FIG. 3 is a view of another embodiment of the invention.

The example of the invention shown in the figures is by no means intended to restrict the invention. The invention can, of course, be freely modified within the scope of the claims. It is thus obvious that the arrangement of the invention or its details do not have to be identical to those shown in the figures but various solutions are feasible. In the example of the figures, the adjustment means, in this case the eccentric sleeves are, for example, arranged on the same axle as the stretching roller. This is not the only feasible solution, however, as the invention can also be applied differently in accordance with the basic idea of the invention. The adjustment means can also be arranged on a different axle than the stretching roller. Instead of the axle 7, the adjustment means 8, for example the eccentric sleeves 8*a,* 8*b,* can be arranged on a different axle, for example, on the axle 15. In the example of FIG. 3, the adjustment means can be preferably arranged at the right-hand end of the axle 15. The surfaces operating as joint points are then arranged on the axle 15 and in the part 10 as described above in connection with the axle 7. It is essential to place the adjustment means on the side of the opposite end of the axle with respect to the stretching roller. Also means other than the eccentric sleeves used in the example of the figure can be used as the adjustment means. The surfaces operating as joint points can also be implemented in various ways. For instance, they can be directly formed on the axle and in the outer eccentric sleeve, respectively, etc.

What is claimed is:

1. An arrangement in connection with a belt drive device having two continuous drive belts which are driven by drive rollers, the drive belts arranged to travel around a plurality of stretching rollers such that the belts form continuous and adjacent loops at a distance from each other and are arranged to be pressed by press rolls against opposite surfaces of a cable to be drawn between the drive belts, the arrangement comprising an adjustment mechanism on an axle, the adjustment mechanism positioned at an end of the axle opposite a side at which at least one of the stretching rollers is positioned to adjust an axial angle of at least one of the stretching rollers of the belt drive device.

2. An arrangement as claimed in claim 1, wherein; and the adjustment mechanism 8*a* are eccentric sleeves (8*a,* 8*b*).

3. An arrangement as claimed in claim 2, wherein the adjustment mechanism is arranged on the axle which is the same axle on which at least one of the stretching rollers is provided.

4. An arrangement as claimed in claim 2, wherein the adjustment mechanism is on the axle which is different than an axle on which at least one of the stretching rollers is positioned.

5. An arrangement as claimed in claim 1, wherein the axle the adjustment mechanism is on is the same axle as at least one of the stretching rollers is on and the adjustment mechanism is on the end of the axle opposite the side at which the at least one stretching roller is positioned.

6. An arrangement as claimed in 5, further comprising surfaces which operate as joint points arranged between the axle and a part which operates as a supporting part of the axle.

7. An arrangement as claimed in claim 6, wherein the surfaces operating as the joint points are formed of arched surfaces.

8. An arrangement as claimed in claim 1, wherein the adjustment mechanism is on the axle which is different than an axle on which at least one of the stretching rollers is positioned.

9. An arrangement as claimed in claim 8, wherein surfaces which operate as joint points are arranged between the axle and a part which operates as a supporting part of the axle.

10. A belt drive device comprising:

two continuous drive belts driven by respective drive rollers;

at least two stretching rollers, one for each of the drive belts, the drive belts travelling around a respective stretching roller, each of the stretching rollers mounted on a respective axle, each of the axles having a first end attached to the stretching roller, and a second free end;

the drive belts forming continuous and adjacent loops at a distance from each other;

press rolls that press the drive belts against each other so that the belts can draw an object between the drive belts; and an adjustment mechanism attached to the free end of one of the axles for adjusting an axial angle of at least one of the stretching rollers by rotation of at least one of the axles.

11. A device as claimed in claim 10, wherein the adjustment mechanism includes two eccentric shafts that rotate to move the axle the adjustment mechanism is attached to for effecting the adjusting.

12. A device as claimed in claim 10, wherein the axle the adjustment mechanism is arranged on is the same axle as that axle on which the at least one stretching roller is positioned to effect the adjusting.

13. A device as claimed in claim 10, wherein the adjustment mechanism is arranged on the axle different than that axle on which the at least one stretching roller is positioned to effect the adjusting.

14. A device as claimed in claim 10, wherein surfaces which operate as joint points are arranged between the axle on which the adjustment mechanism is attached and a part which operates as a supporting part of the axle on which the adjustment mechanism is attached.

* * * * *